United States Patent [19]

Conroy

[11] 3,991,390

[45] Nov. 9, 1976

[54] SERIES CONNECTED STRIPLINE BALUN

[75] Inventor: Peter J. Conroy, Scottsdale, Ariz.

[73] Assignee: Motorola, Inc., Chicago, Ill.

[22] Filed: July 31, 1975

[21] Appl. No.: 600,832

[52] U.S. Cl. ..... 333/26; 333/10

[51] Int. Cl.[2] ..... H01P 5/10

[58] Field of Search ..... 333/10, 26

[56] References Cited

UNITED STATES PATENTS

| | | | |
|---|---|---|---|
| 3,345,585 | 10/1967 | Hildebrand | 333/10 |
| 3,500,259 | 3/1970 | Seidel | 333/10 UX |
| 3,721,912 | 3/1973 | Ross | 333/26 X |
| 3,818,385 | 6/1974 | Mouw | 333/26 |
| 3,883,828 | 5/1975 | Capucci | 333/10 |

*Primary Examiner*—Paul L. Gensler

*Attorney, Agent, or Firm*—Harry M. Weiss; Michael D. Bingham

[57] ABSTRACT

A stripline-to-two-conductor balun comprising series connected transverse electric magnetic mode (TEM) 90° stripline couplers to transform an unbalanced stripline TEM field to a two wire TEM balanced field. The coupler sections of the balun comprises two overlay parallel conductors deposited on opposite sides of a dielectric layer and includes input stripline circuitry adapted to be connected to the input of one coupler section of the balun. The dielectric layer is disposed between and insulated from two parallel ground plane members. The output conductors are coupled through one ground plane member and are electrically connected respectively to one of an antiphase coupled arm of each series connected coupler section. The other coupled arm of each series connected coupler is terminated in a radio frequency (RF) short circuit, the direct coupled arm of the second coupler section is terminated in an open circuit.

8 Claims, 7 Drawing Figures

SERIES CONNECTED STRIPLINE BALUN

BACKGROUND OF THE INVENTION

This invention relates to unbalanced-line to balance-line converters, or baluns and more particularly to an improved series connected stripline balun.

Coaxial baluns are well known in the art, being used as transitions between coaxial transmission lines and antennas. However, most prior art coaxial baluns suffer from a serious limitation in that the physical size of the balun limits its usefulness. Moreover, coaxial baluns are very difficult to fabricate and are not easily adapted to use with printed circuit input circuitry.

Thus, there exists a need for a compact stripline balun having a wide frequency bandwidth with low load input VSWR which is not dependent on the impedance match of the device.

SUMMARY OF THE INVENTION

Accordingly, it is a principal object of the invention to provide an improved stripline balun.

It is another object of the invention to provide a stripline-to-two-conductor balun having improved frequency bandwidth and voltage standing wave ratio, (VSWR) characteristics.

Still another object of the invention is to provide an improved series connected stripline balun comprising stripline couplers.

In accordance with the present invention, the stripline-to-two-conductor balun includes a dielectric layer having first and second planar surfaces that is sandwiched between two dielectric substrates, each of the dielectric substrates being copper plated on their surfaces disposed away from the dielectric layer such that a balance ground reference is formed for the balun. Etched on both planar surfaces of the dielectric layer are at least two series connected TEM-mode 90° stripline overlay couplers. The input arm or port of the first stripline coupler is adapted to be connected to input circuitry of the balun and has its ninety degree coupled output port directly connected to the input port of the second coupler. The inphase coupled port of the first stripline coupler is terminated in an RF short circuit so that power is coupled to what otherwise would be the isolated port. Thus, the power coupled to the latter port is of antiphase relationship to the power appearing at the ninety degree coupled output port of the first stripline coupler. By selectively terminating the ninety degree coupled output port and the isolated port of the second stripline coupler respectively in an RF open and short circuit, the power applied at the inphase coupled port thereof is of equal but antiphase relationship to the power appearing at the otherwise isolated port of the first stripline coupler. A pair of output conductors are respectively connected to the two antiphase coupled arms of each coupler section, the conductors passing through one of the dielectric substrates and being adapted to be connected to the output circuitry of the balun.

DETAILED DESCRIPTION OF THE PREFERRED EMBODIMENT

Figure 1:
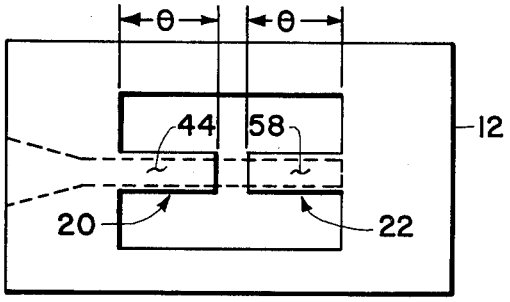
FIG. 1 is a top view (top ground plane member removed) of the present invention illustrating the stripline circuit as etched on the top side of the dielectric layer of the stripline balun.
Figure 2:
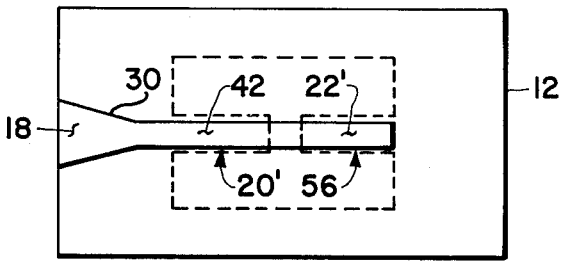
FIG. 2 is a bottom view of the dielectric layer of FIG. 1.
Figure 3:
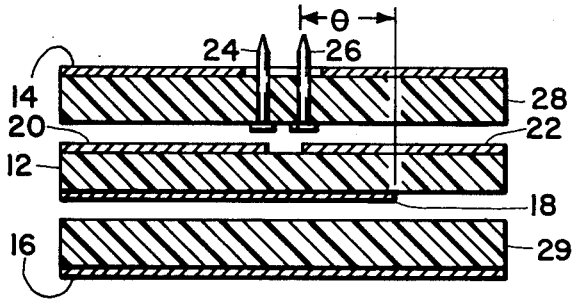
FIG. 3 is an exploded sectional view of the stripline balun of FIG. 1.

A stripline balun constructed in accordance with the principal of the invention is illustrated in detail by FIGS. 1, 2 and 3 of the drawings. Balun 10 comprises a dielectric layer 12 and ground plane members 14 and 16, respectively. In construction, dielectric layer 12 includes stripline input circuitry 18 on the bottom planar surface thereof and overlay coupler sections 20-20′ and 22-22′ on the top and bottom surfaces thereof. In accordance with known techniques, stripline coupler sections 20-20′ and 22-22′ are overlay couplers which are capacitively coupled to input circuitry 18. The balanced output of balun 10 is provided by output connectors 24 and 26 which are electrically connected to couplers 20 and 22 respectively. Dielectric layer 12 is sandwiched between and electrically insulated from ground plane members 14 and 16 by dielectric insulating members 28 and 29, respectively. Stripline input member 18 may include transformer section 30, if needed, for transforming the input impedance of the circuit connected to balun 10 to the balun impedance.

Figure 4:
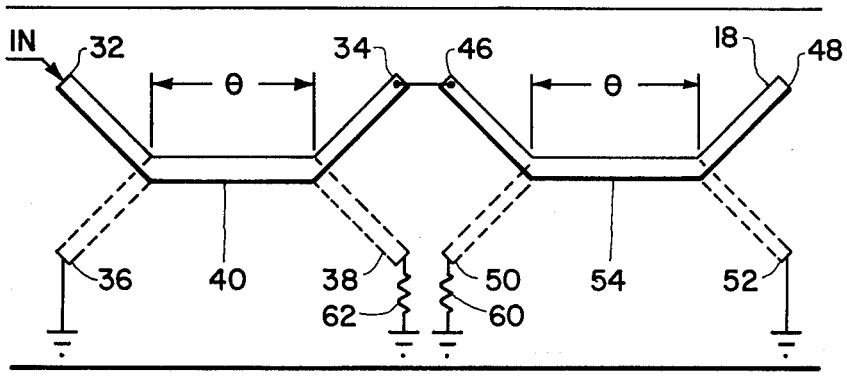
FIG. 4 is a schematic illustration of the stripline balun of the invention.

Shown schematically in FIG. 4, balun 10 operatively functions as two serially connected TEM-mode stripline overlay couplers, each of the particular stripline couplers being well known in the art. Coupler 20-20′ is shown as having input port 32 connected to input circuitry 18, ninety degree coupled output port 34 and coupled ports 36 and 38, in normal operation port 38 would be isolated, as is known in the art. Coupling section 40 of the first overlay coupler is of a predetermined electrical length ($\theta$) and comprises portion 42 on the bottom surface of dielectric layer 12 and portion 44 on the top planar surface thereof. The amount of power which is coupled to ports 34 and 36 is a function of the amount of overlay between circuit portions 44 and 42, as is understood in the art. Similarly, the second overlay coupler comprises an input port 46 which is directly connected to 90° coupled port 34, a 90° coupled port 48 which is terminated in a RF open circuit and coupled ports 50 and 52. Coupling section 54 is fabricated in the same manner as coupling section 40 of the first overlay coupler section and comprises coupler section 56 and 58, respectively. Coupled ports 36 and 50 are respectively terminated in a RF short circuit and to one side of the balun output impedance 60. The other coupled ports 38 and 52 are terminated respectively to the other side of the balun output impedance 62 and another RF short circuit. The above described stripline balun can be readily fabricated using commercially available stripline boards and standard printed circuit techniques.

The operation of individual stripline overlay couplers 20-20′ 22-22′ is well known in the art and only a brief description thereof will be hereinafter described. If, for example, it is assumed that the coupling factor, K, is 3dB (which is a function of the amount of overly), the input power applied to input port 32 will be equally divided such that the magnitude of the power appearing at the port 36 equals the power appearing at port 34. If the electrical length ($\theta$) of coupling section 40 is made to be ninety degrees at the center operating frequency, the phase of the power appearing at port 34 will be ninety degrees offset from the power appearing at port 36. The latter will be in phase with the power supplied to input port 32. In normal operation port 38 is isolated, i.e., no power will be coupled thereto. The operation of coupler 22-22' is of a like manner. However, by terminating selected ports of coupler sections 20-20' and 22-22' in either RF short or open circuits, the input power applied to input port 32 is coupled to ports 38 and 50 such that the power appearing thereat is of equal amplitude having an antiphase relationship, i.e., the power at port 38 is 180° out of phase with the power appearing at port 50. Thus, the unbalanced input power is converted to a balanced output power at ports 38 and 50, which may be used to drive the balanced load circuit of balun 10, shown figuratively as load resistors 62 and 60, respectively. Therefore, the output impedances 62, 60 are serially connected with the input to balun 10 being parallel-coupled thereto. Thus, a major advantage of balun 10 is that the input impedance and the bandwidth of balun 10 are solely dependent on the degree of coupling between the coupler sections.

Referring to FIG. 4, an explanation of the above described phenomenon is given. By terminating in phase port 36 of coupler section 20-20' in an RF short circuit, the power appearing thereat is reflected having an 180° shift in its phase. The reflected power is directly supplied to port 38 with an additional phase shift of ninety degrees. Thus, the power appears at port 38 is 180° out of phase with the power appearing at port 34. Because the power coupled from port 34 to input port 46 of coupler 22-22' to in phase port 50 appears without any phase shift introduced thereto, the phase of the power coupled to ports 38 and 50 are antiphase with respect to each other. By terminating port 48 and 52 in an RF open and short circuit respectively, the magnitude of the power appearing at port 50 will be substantially equal to the power appearing at port 38, regardless of the coupling factor K of the individual coupler sections as long as each individual coupler section is fabricated to have the same coupling factor.

Another major advantage of the aforedescribed balun is that the output thereof can be applied to coaxial or two wire striplines without any necessary intercoupling transforming being required. This is very important in applications where the physical size of balun is critical.

The aforedescribed balun is not necessarily limited only for transforming unbalanced stripline TEM fields to a two wire TEM balanced field. Besides having the capability of being utilized to feed a broadband antenna, such as a spiral or log periodic planar antennas, balun 10 may be used as either a power divider or combiner. For example, if used as a power divider, the input power at port 32 of balun 10 will be equally divided and appear at output port 38 and 50 thereof. It is understood that any degree of coupling can be achieved using the above coupler sections 20-20' and 22-22' by varying the amount of overlay of the parallel lines comprising coupler sections 40 and 54. If used as a combiner, the aforedescribed balun circuit would provide a single output at port 32 which is the sum of the power supplied at ports 38 and 50, respectively.

Figure 5:
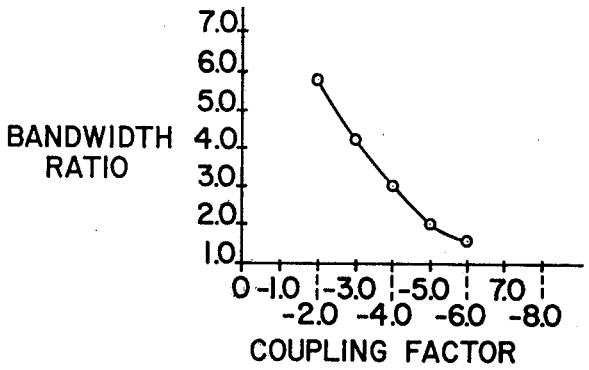
FIG. 5 is a chart illustrating the bandwidth ratio of the stripline balun of the present invention as a function of the coupling factor thereof.
Figure 6:
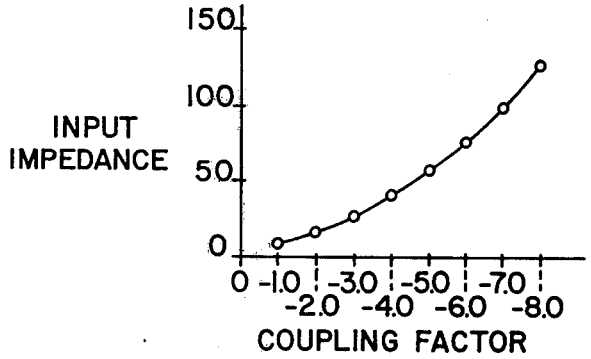
FIG. 6 is a chart illustrating input impedance as a ratio to the coupling factor of the stripline balun of the present invention.
Figure 7:
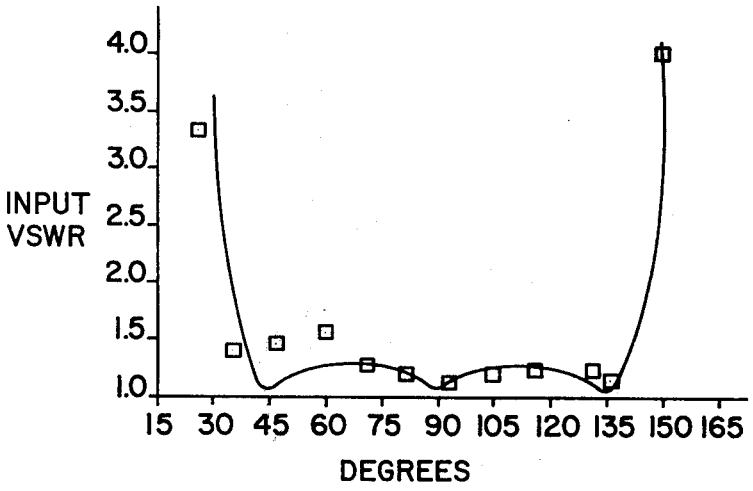
FIG. 7 is a chart illustrating input VSWR as a function of the electrical length of the coupler sections of the stripline balun of the present invention.

FIGS. 5, 6 and 7 illustrate the typical characteristics of balun 10. For example, with the impedance of each individual coupler section being a constant, typically 50 ohms, by varying the coupling factor, K, different impedance transformations can be affected over wide bandwidths. FIG. 5 illustrates that, with a coupling factor of 3dB, the bandwidth of balun 10 is greater than 4:1. FIG. 6 illustrates that the typical input impedance of balun 10 is 25 ohms with a 3dB coupling factor. Thus, assuming a typical situation wherein an unbalanced input is to be transformed to a balanced load of 100 ohms, balun 10 provides greater than a 4:1 bandwidth with a 4:1 impedance ratio. Graph 7, the measured input VSWR of a balun fabricated using the above described techniques, illustrates that the balun is capable of having a VSWR less than 2:1 over greater than a 400% bandwidth.

What has been described above is an improved stripline balun. The balun has the advantage over prior art circuits in that the input impedance and bandwidth thereof depends solely on the degree of coupling between the parallel lines of the series connected uniquely terminated TEM-mode ninety degree overlay coupler sections. Another major advantage over prior art baluns is that the output thereof can drive either coaxial, two wire or stripline circuits.

While the invention has been described in one presently preferred embodiment, it will be understood by those skilled in the art that changes in the form and details may be made therein without departing from the spirit and scope of the invention.

What is claimed is:

1. A balun suitable for being fabricated utilizing stripline circuit techniques, comprising:

first and second ground plane members in spaced parallel relationship to one another, each one of said ground plane members including a dielectric substrate having opposed planar surfaces with the outward facing surface of each of said dielectric substrates having a ground plane disposed thereon;

a dielectric layer having first and second planar surfaces contiguously disposed between the inward facing surfaces of said dielectric substrates of said first and second ground plane members; and stripline circuitry formed on said first and second planar surfaces of said dielectric layer having an input terminal adapted to receive an electrical signal, output terminals and including two serially connected ninety degree stripline couplers, the first of said two couplers having a first port terminated in a radio frequency (RF) short circuit and a second port coupled to a first one of said output terminals, the second of said two couplers having a first port coupled to a second one of said output terminals, a second port terminated in a RF short circuit and a third port terminated in a RF open circuit such that the electrical signals appearing at said output terminals are substantially equal in magnitude and antiphased with respect to each other.

2. The balun of claim 1 wherein each individual stripline coupler circuit includes an input port, a coupling section, an in phase coupled port, a normally isolated port, and an output coupled port, said coupling section including first and second stripline circuit portions of a predetermined length, said first and second stripline circuit portions being respectively disposed on said first and second planar surfaces of said dielectric layer, said first one of said at least two stripline coupler circuits having said input port coupled to said input terminal of the balun, said in phase port being said first port, said normally isolated port being said second port such that power applied to said first coupler is reflected from said RF short circuit terminating said in phase port, to said normally isolated port said power having a predetermined magnitude and phase, and said output coupled port of said first one of said at least two stripline coupler circuits is connected to said input port of the second one of said stripline coupler circuits.

3. The balun of claim 2 wherein said second stripline coupler circuit further includes said output coupled port being said third port and said isolated port being said second port so that power is produced at said in phase port thereof which is of substantially equal magnitude but opposite phase to said power appearing at said normally isolated port of said first stripline coupler circuit, said in-phase coupled port being said first port.

4. The balun of claim 1 wherein the coupling factor of each of said at least two stripline coupler circuits is 3 dB.

5. The balun of claim 1 wherein said stripline circuitry further includes transformer means interposed between said input port of said first stripline coupler circuit and said input terminal for transforming an input impedance connected to the balun to the impedance of the balun.

6. The balun of claim 2 wherein the coupling factor of each of said at least two stripline coupler circuits is 3 dB.

7. The balun of claim 6 wherein said stripline circuitry further includes transformer means interposed between said input port of said first stripline coupler circuit and said input terminal for transforming an input impedance connected to the balun to the impedance of the balun.

8. A stripline directional coupler circuit suitable to be operated over a wide range of input frequencies, comprising:

a first stripline coupler having an input port, first and second coupled ports and an isolated port, said first coupler being responsive to an input signal applied to said input port such that said signal is coupled to said first and second coupled ports, said second coupled port being terminated in a radio frequency (RF) short circuit such that said signal coupled thereto is reflected to said isolated port, said signal appearing at said isolated port having a predetermined phase and magnitude with respect to said input signal; and a second stripline coupler having an input port, first and second coupled ports and an isolated port, said input port being coupled to said first coupled port of said first coupler, said first coupled port being terminated in an RF open circuit and said isolated port being terminated in an RF short circuit such that the coupled signal applied to said input port form said first coupler appears at said second coupled port, said signal at said second coupled port being substantially equal in magnitude to said signal appearing at said isolated port of said first coupler and being in antiphase relation to the same.

* * * * *